US006311366B1

(12) United States Patent
Sepke et al.

(10) Patent No.: US 6,311,366 B1
(45) Date of Patent: Nov. 6, 2001

(54) BATTERY POWER COMBINATION VACUUM CLEANER

(75) Inventors: Arnold L. Sepke, Hudson; Vincent Bobrosky, Normal, both of IL (US)

(73) Assignee: White Consolidated Industries, Inc., Cleveland, OH (US)

( * ) Notice: Subject to any disclaimer, the term of this patent is extended or adjusted under 35 U.S.C. 154(b) by 0 days.

(21) Appl. No.: 09/441,492

(22) Filed: Nov. 17, 1999

Related U.S. Application Data

(60) Provisional application No. 60/108,912, filed on Nov. 18, 1998.

(51) Int. Cl.[7] ..... A47L 9/22

(52) U.S. Cl. ..... 15/412; 15/329; 15/352; 15/DIG. 1

(58) Field of Search ..... 15/328, 329, 350–352, 15/354, 377, 412, DIG. 1

(56) References Cited

U.S. PATENT DOCUMENTS

| | | | | |
|---|---|---|---|---|
| D. 307,657 | * | 5/1990 | Li | 15/350 |
| 1,918,519 | | 7/1933 | Clements . | |
| 1,983,566 | | 12/1934 | Replogle . | |
| 2,340,944 | * | 2/1944 | Easter | 15/344 |
| 4,521,936 | | 6/1985 | Medwed . | |
| 4,570,286 | | 2/1986 | Ross . | |
| 4,573,236 | | 3/1986 | Dyson . | |
| 4,638,526 | | 1/1987 | Murata et al. . | |
| 4,660,246 | | 4/1987 | Duncan et al. . | |
| 4,662,026 | | 5/1987 | Sumerau et al. . | |
| 4,670,973 | | 6/1987 | Sumerau et al. . | |
| 4,766,638 | | 8/1988 | McDowell . | |
| 4,835,409 | | 5/1989 | Bhagwat et al. . | |
| 4,841,594 | | 6/1989 | Elson et al. . | |
| 4,928,346 | | 5/1990 | Elson et al. . | |
| 4,968,174 | | 11/1990 | Krasznai . | |
| 5,014,388 | * | 5/1991 | Schiazza et al. | 15/412 |
| 5,020,186 | * | 6/1991 | Lessig et al. | 15/351 |
| 5,042,109 | * | 8/1991 | Stephens | 15/354 |
| 5,086,536 | | 2/1992 | Lackner et al. . | |
| 5,283,939 | | 2/1994 | Saunders et al. . | |
| 5,296,769 | | 3/1994 | Havens et al. . | |
| 5,309,600 | | 5/1994 | Weaver et al. . | |
| 5,347,679 | | 9/1994 | Saunders et al. . | |
| 5,446,943 | | 9/1995 | Sovis et al. . | |
| 5,524,321 | | 6/1996 | Weaver et al. . | |
| 5,564,160 | | 10/1996 | Luebbering . | |
| 5,606,770 | * | 3/1997 | Sovis et al. | 15/412 |
| 5,765,258 | * | 6/1998 | Melito et al. | 15/412 |
| 5,966,774 | * | 10/1999 | Bone et al. | 15/350 |

FOREIGN PATENT DOCUMENTS

| | | |
|---|---|---|
| 985891 | 3/1965 | (GB) . |
| 1262121 | 2/1972 | (GB) . |

* cited by examiner

*Primary Examiner*—Terrence R. Till
(74) *Attorney, Agent, or Firm*—Pearne & Gordon LLP

(57) ABSTRACT

A battery-powered vacuum cleaner that may be converted from a conventional on-the-floor cleaner to a portable canister cleaner for off-the-floor or on-the-floor cleaning operations. The vacuum cleaner has a filter chamber comprising a removable dirt cup having a substantially flat filter oriented in the direction of air flow. A fan and motor assembly is angularly related to the longitudinal axis of the vacuum cleaner to provide a lower profile of the cleaner housing while cleaning under low clearance objects. A handle is adjustable relative to the housing, or it may be removed to convert the cleaner to a portable canister.

26 Claims, 13 Drawing Sheets

26
24
32
30
42
34
28
32
38
36
50
48
70
52
76
104
100
106
102
110
118
280
298
308
310
294
296
304
282
284
356
302
88
124
130
82
126
54
290
292
286
288
132
90
84
316
314
318
312
304
152
140
134
22
300
352
306
348
350
354

BATTERY POWER COMBINATION VACUUM CLEANER

A claim for priority is hereby made under the provisions of 35 U.S.C. 119(e) for the above-identified U.S. patent application based on U.S. Provisional Application Ser. No. 60/108,912, filed Nov. 18, 1998.

This invention relates to vacuum cleaners and, more particularly, to battery powered vacuum cleaners which may be converted from an upright cleaner to a canister cleaner and, further, to a canister cleaner which may be carried by a shoulder strap for on the floor or off the floor cleaning operations.

BACKGROUND OF THE INVENTION

Battery powered upright cleaners are typically designed to perform specific cleaning functions such as bare floor cleaning and small area cleaning on carpets and rugs. These vacuum cleaners are useful as an accessory to a full size carpet cleaner for small jobs. It is desirable, however, to have a cleaner which is versatile enough to perform the functions of a full size vacuum but possess the advantages of a portable stick vac and a portable canister vac which may be carried by a shoulder strap.

BRIEF DESCRIPTION OF THE INVENTION

This invention provides a powerful upright style battery powered vacuum cleaner, but which may be converted into a portable canister cleaner for both on the floor and off the floor cleaning operations. The vacuum cleaner includes an upper body containing a battery, a suction motor, a multi-position extension handle, and a removable dust cup. The upper body is pivotally connected to a floor engaging nozzle assembly ahead of a brush roll air intake orifice. Toward the rear of the nozzle assembly are two rearwardly extending projections which are spaced apart and to which rear wheels are mounted. The mounting projections are spaced apart to allow the upper body assembly to pivot 90 degrees from the vertical storage position to a ground-hugging overall height that aids in gaining cleaning access under low objects such as beds, chairs, couches, etc.

Consistent with the objective to provide a low profile for the cleaning operations described above, the motor and fan unit in the upper body is mounted so that the axis of fan rotation is angularly related to the longitudinal axis of the upper body, and so that the fan presents an elliptical envelope of rotation when viewed in the direction of the longitudinal axis of the upper body. This arrangement permits the height of the upper body housing to be reduced for the previously described cleaning operations.

According to a further aspect of this invention, the upper body provides a containment chamber. The containment chamber is provided with a substantially planar filter which extends from a distal end to a proximal end of the containment chamber to separate the chamber into an airflow chamber and a dirt chamber. The direction of flow of dirt-laden air is substantially parallel to the filter so that dirt is not built up on the filter but tends to be swept away by the incoming air stream. The containment chamber is easily removed and emptied without removing the filter during each disposal operation. Periodically, the filter may be cleaned by removing it from the containment chamber. According to a further aspect of this invention, the fan comprises an impeller having a pair of circular faces one of which has a circular central opening therethrough. A plurality of spaced curved vanes are provided between the plates extending outwardly from the central opening to an outer periphery of each plate. A windguard supports the motor and fan unit.

The windguard comprises spaced mounting plates, the first one of which supports the motor and a second one of which has an air cone conduit. The fan is located between the plates and a plurality of exhaust vanes connect the plates just outward of the path of travel of the fan to extend a short distance from the end of the plates. The vanes extending from the plates are received in lateral slots in the housing to aid in supporting the entire assembly. An air guard cylinder extends axially from the central opening of the fan and is received in the circular opening of the air cone conduit in closely spaced relationship. The other end of the air guard cylinder forms a laterally elongated opening which communicates with an elongated aperture in an end wall of the containment chamber. Air is thus drawn in from the containment chamber into the eye of the fan and then radially outwardly through the vanes between the plates to the outside environment.

The motor housing is connected to a lower accessory receiving assembly by a longitudinal spine. The containment chamber is removably mounted on the spine between the motor housing and the accessory receiving assembly. A tubular opening is defined by the accessory receiving assembly and is in fluid communication with an intake opening in the containment chamber. The floor and rug cleaning housing wall nozzle is attached to the accessory receiving assembly by an outlet tube which is pivotally connected to the floor and rug cleaning nozzle. The tube may be removed from the accessory receiving assembly and a hose may be connected to the assembly to convert the unit into a canister cleaner.

A handle is telescoped into the spine of the vacuum cleaner and may be adjusted to project at different extensions from the cleaner to accommodate persons of different height. For canister cleaning operations the handle may be entirely removed from the unit, a carrying strap may be attached to the cleaner and the cleaner may be carried about as a portable on or off the floor cleaning unit.

Molded into the housing is a compartment for the battery providing accessibility from the exterior of the housing. A disconnect connection is provided on the housing to electrically engage the battery and to provide terminals for leads which run along the spine of the vacuum to the motor housing and to a switch provided at the upper portion of the housing. Leads may also extend to the accessory mounting assembly to be associated with quick disconnect connectors on the rug nozzle to a brush roll motor so that a powered brush roll accessory may be provided.

DETAILED DESCRIPTION OF THE INVENTION

Figure 1:
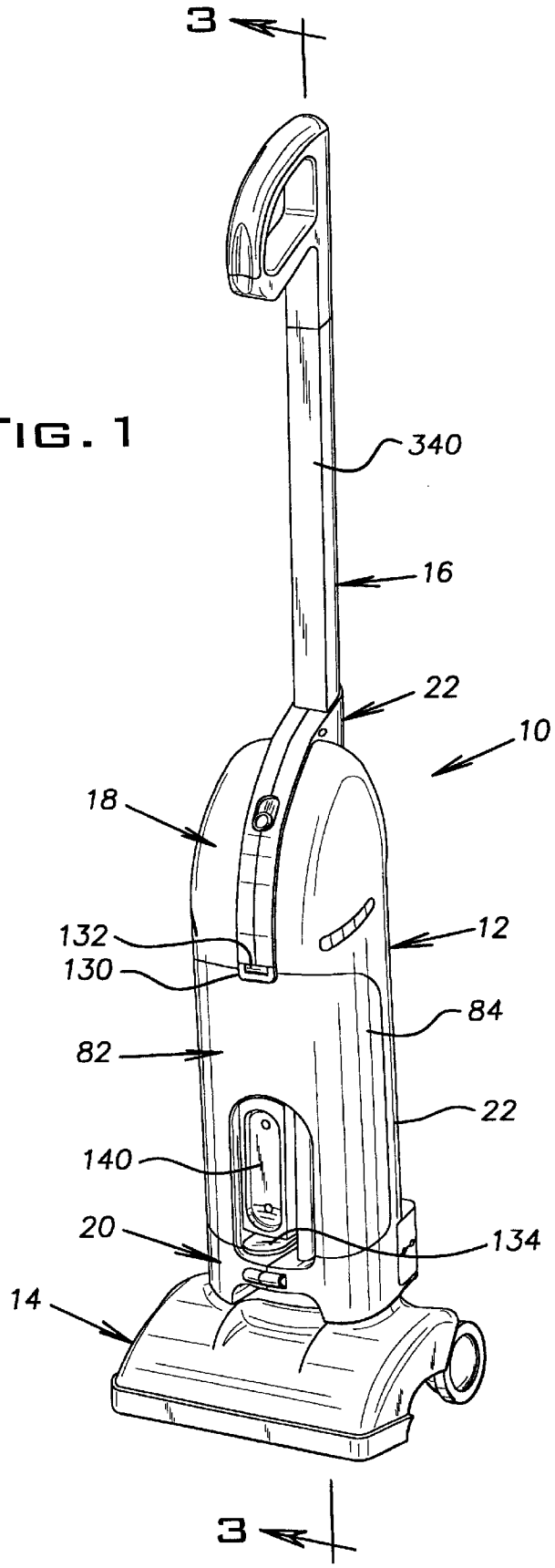
FIG. 1 is a perspective view of a vacuum cleaner according to this invention.

Referring particularly to FIGS. 1, 2A, 2B, and 2C of the drawings there is illustrated a battery operated upright vacuum cleaner 10. The vacuum cleaner 10 includes an elongated casing or upper body member 12 which is pivotally connected at its distal end to a floor and rug cleaning housing 14 and has a handle 16 projecting from its distal end. The elongated casing 12 includes a motor housing 18 at one end and an accessory receiving assembly 20 at its other end. The motor housing 18 and the assembly 20 are joined by a spine 22.

Figures 4, 5:
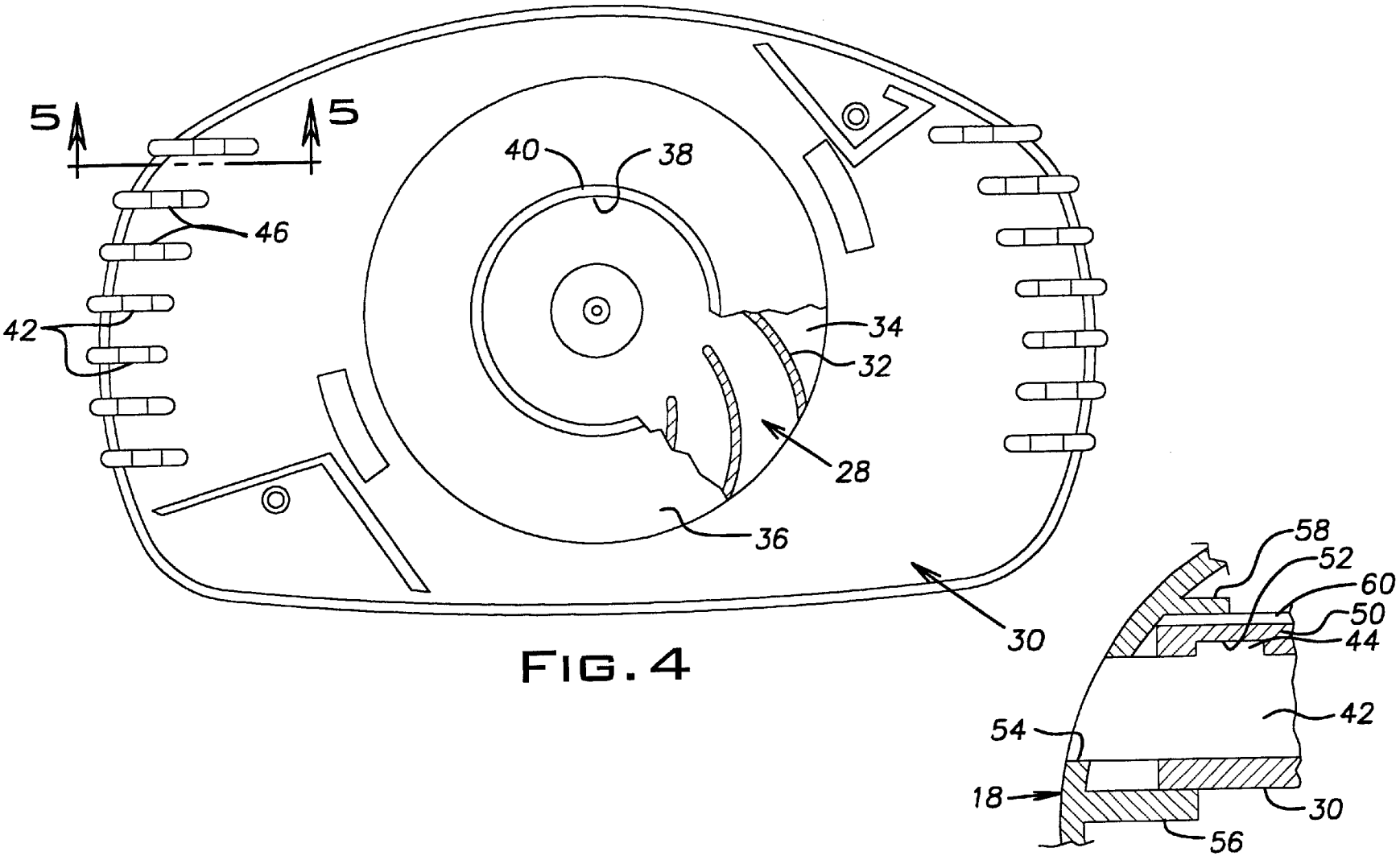
FIG. 4 is a cross sectional view, the plane of the section being indicated by the line 4—4 in FIG. 3.
FIG. 5 is a fragmentary sectional view, the plane of the section being indicated by the line 5—5 in FIG. 4.
Figure 6:
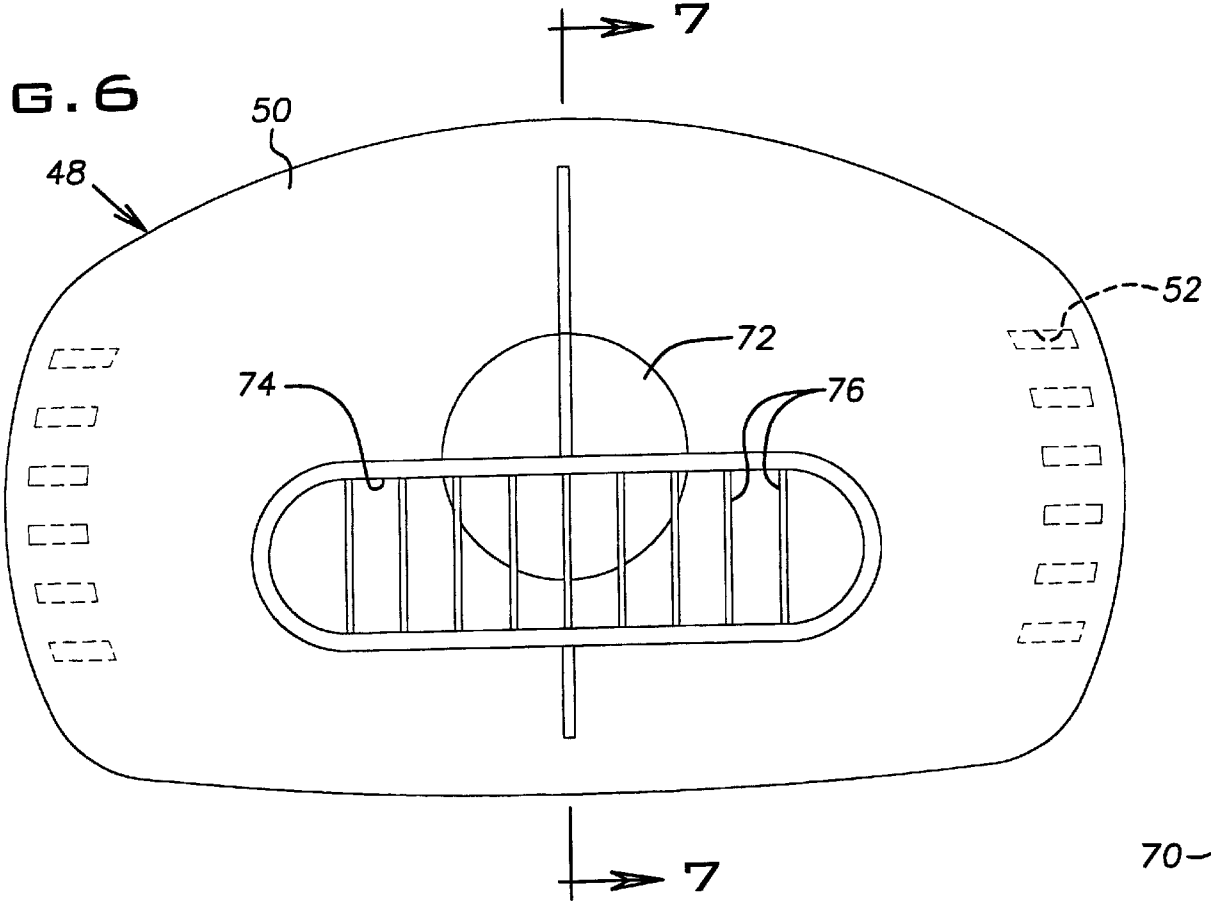
FIG. 6 is a cross sectional view, the plane of the section being indicated by the line 6—6 in FIG. 3.

Mounted within the motor housing 18 is a motor and fan assembly 24 (FIGS. 2A, 2B, 2C, and 3). The assembly 24 includes a motor 26 and a fan 28. The motor 26 is mounted on a fan cover plate 30 within a central socket 32. The fan 28 is mounted for rotation on the other side of the plate 30 and as may be seen in FIG. 4 comprises a plurality of curved vanes 32 extending between first and second mounting disks 34 and 36. The disk 36 has a central air intake opening 38 defined by a cylindrical air guard 40. A plurality of laterally extending air guide vanes 42 are provided along the lateral edges of the plate 30 and each vane 42 has an extending tab 44 (FIG. 5). A reducer 48 having a base plate 50 (FIG. 6) is assembled on the motor fan assembly by a plurality of recesses 52 provided in the plate 50. The plate 50 and the plate 30 are spaced apart a distance so that both plates are spaced closely adjacent the fan 28.

The fins 46 project beyond the edges of the plates 50 and 30 and are received in a slot 54 in the housing 18. The slot 54 and spaced parallel ribs 56 and 58 serve to retain the motor fan assembly and the housing 18. A gasket 60 is provided between the plate 50 and the rib 58 to seal the motor fan unit.

Figure 3:
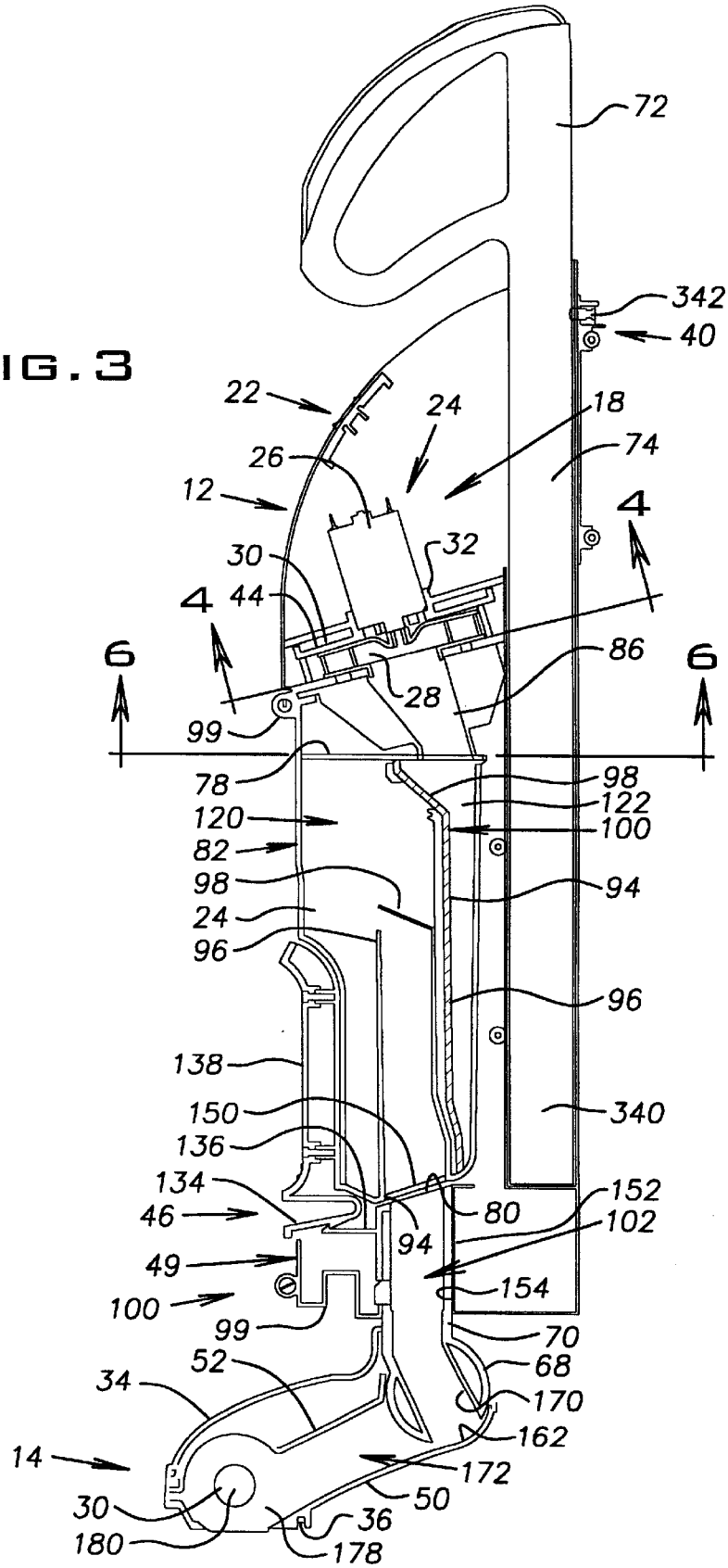
FIG. 3 is a sectional view, the plane of the section being indicated by the line 3—3 in FIG. 1.

As may be seen most clearly in FIG. 3 the ribs 56 and 58 and the slots 54 mount the motor fan assembly at an angle with respect to a longitudinal axis of the upper body 12. This angular mounting arrangement reduces the profile of the outer fan unit as viewed along the axis so that the width of the housing 12 measured normal to the axis may be reduced. As will become apparent reduction of this width enables the user to clean under low clearance items of furniture such as beds or the like.

Figure 7:
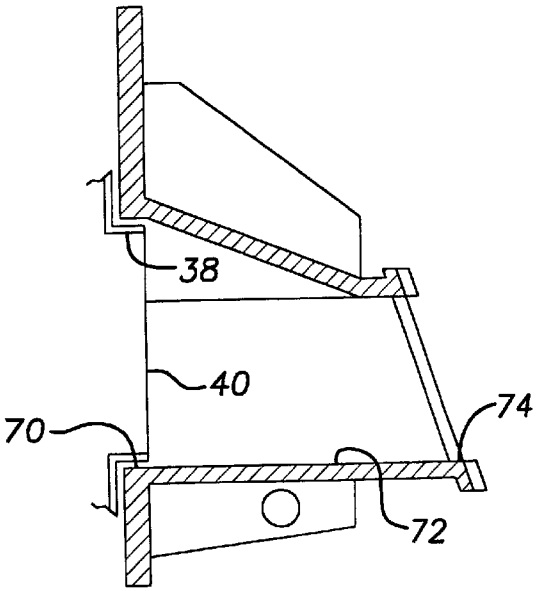
FIG. 7 is a cross sectional view, the plane of the section being indicated by the line 7—7 in FIG. 6.

As may be seen in FIG. 7 the angular rim 38 projects into an opening 70 in the plate 50 and is closely spaced thereto. The opening 70 communicates with a reducer tube 72 which projects from the plate 50 as a cylinder and then flows laterally outwardly to form an elongated opening 74. The opening 74 is covered by a grate 76 and is sealed to an end wall 78.

Figure 8:
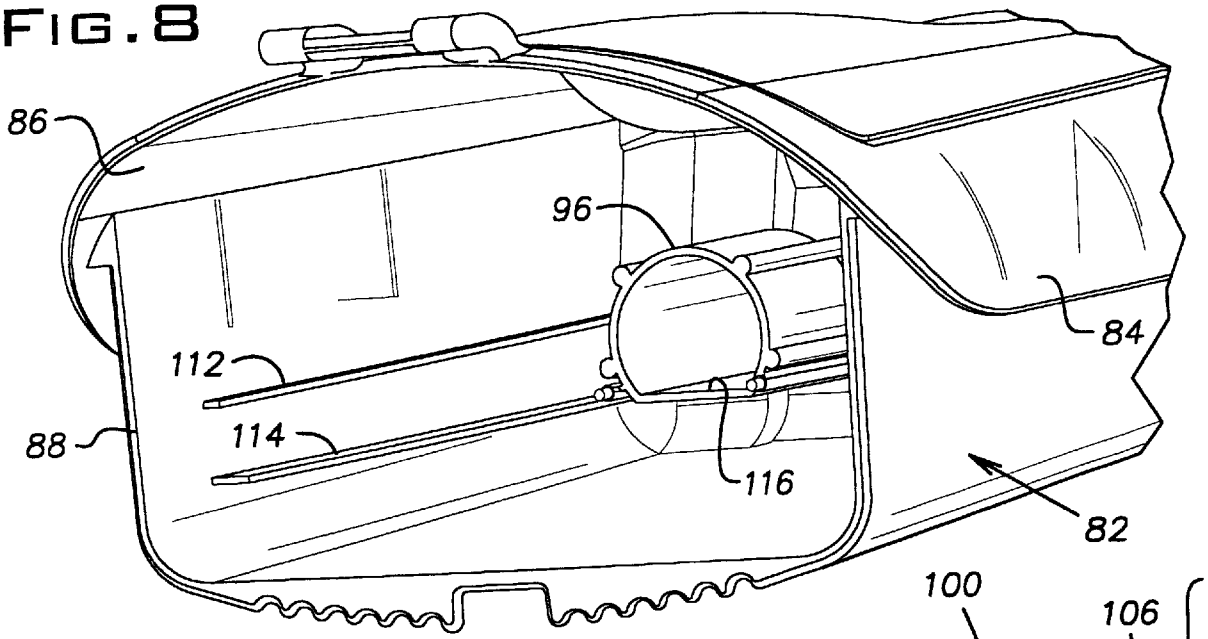
FIG. 8 is a perspective view of the dirt containment chamber illustrating the filter removed therefrom.
Figure 9:
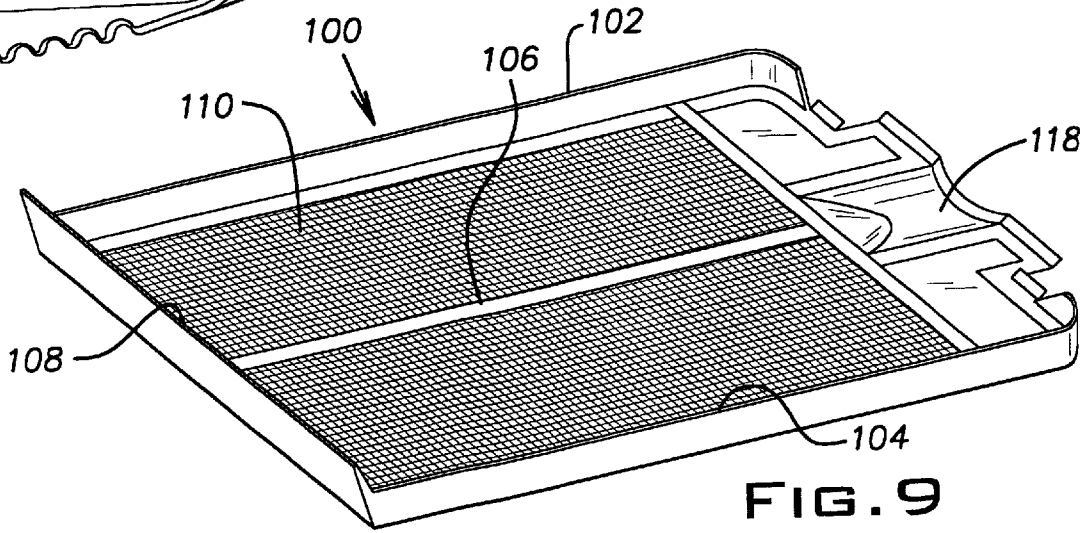
FIG. 9 is a perspective view of the filter.
Figure 10:
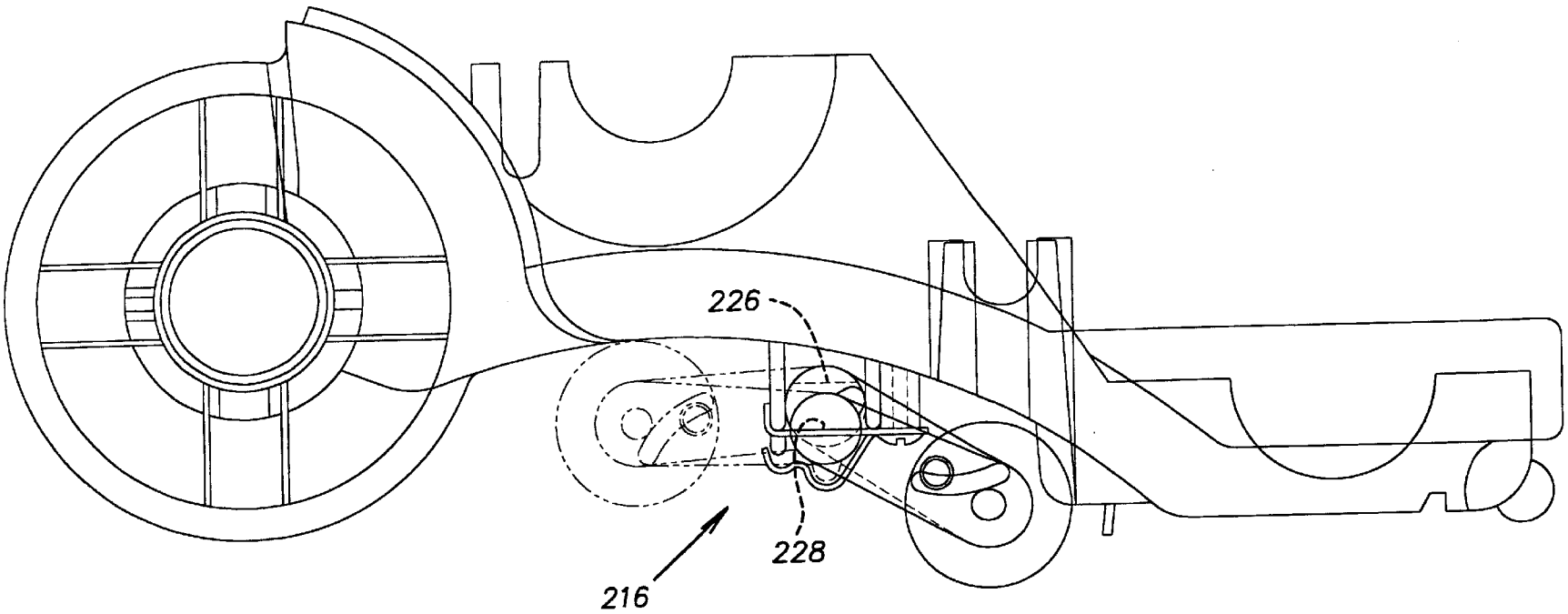
FIG. 10 is a sectional view of the rug nozzle according to one aspect of this invention.

The end wall 78 and an opposite wall 80 define a cavity which receives a dust cup 82. The cup 82 is generally rectangular but has a front face 84 molded to conform to the configuration of the body 12. As may be seen in FIGS. 3 and 8, one end of the cup 82 has an open mouth defined by an edge 88 which is sealed against the end wall 78. The front face 84 extends around a recess 90 in the housing 18 and is sealed by a gasket 92. Thus the cup 82 is in fluid communication with the intake of the fan 28. The other end of the cup is closed but has an opening 94 which communicates with an intake tube 96. The intake tube 96 is provided with a flapper valve 98 at its upper end to minimize the gravitational discharge of debris.

A substantially flat filter element 100 is removably mounted in the dirt cup 82. The filter 100 is preferably made from plastic and has a framework which comprises longitudinal sides 102 and 104 and a central frame member 106. A rectangular frame 108 is provided at one end of the filter. A filter fabric 110 extends between the sides 102 and 104 and extends across the frame 108. The filter 100 is mounted in the dirt cup by sliding the filter edges 102 and 104 between parallel ribs 112 and 114 which are provided on opposite sides of the dirt cup 82. It may be noted in FIG. 8 that one side 116 of the tube 96 is flattened to closely face the filter fabric 110. The flattened portion flows at its lower end to a full cylinder to provide a circular opening at the inlet 94. The cylindrical portion of the tube 96 is accommodated by a complimentary cylindrical impression 118 at one end of the filter.

As may be seen in FIG. 3 the filter 100 separates the interior of the dirt cup 82 into a dirty air chamber 120 and a clean air chamber 122. Since the face of the filter screen 110 is substantially in the direction of dirty air flow the screen tends not to be deeply embedded with dirt and the dirt tends to collect in the cup rather than on the filter screen. Thus the cup may be emptied without removing and cleaning the screen after each use. However, when the screen is completely coated with dirt the filter is easily removed from the dirt cup and thoroughly cleaned. To aid in this operation, it may be noted in FIG. 8 that one edge 124 of the dirt cup 82 is provided with a series of comb-like projections 126 which may be used as an aid in scraping the surface of the filter screen 110.

The dirt cup 82 is retained in an operating position by an upper loop 130 which is placed over a hook 132 on the housing 18. A lower spring hinge 134 snaps over and is retained by a detent 136. A handle grip 140 is provided at the front face of the dirt cup 82.

Figure 2A:
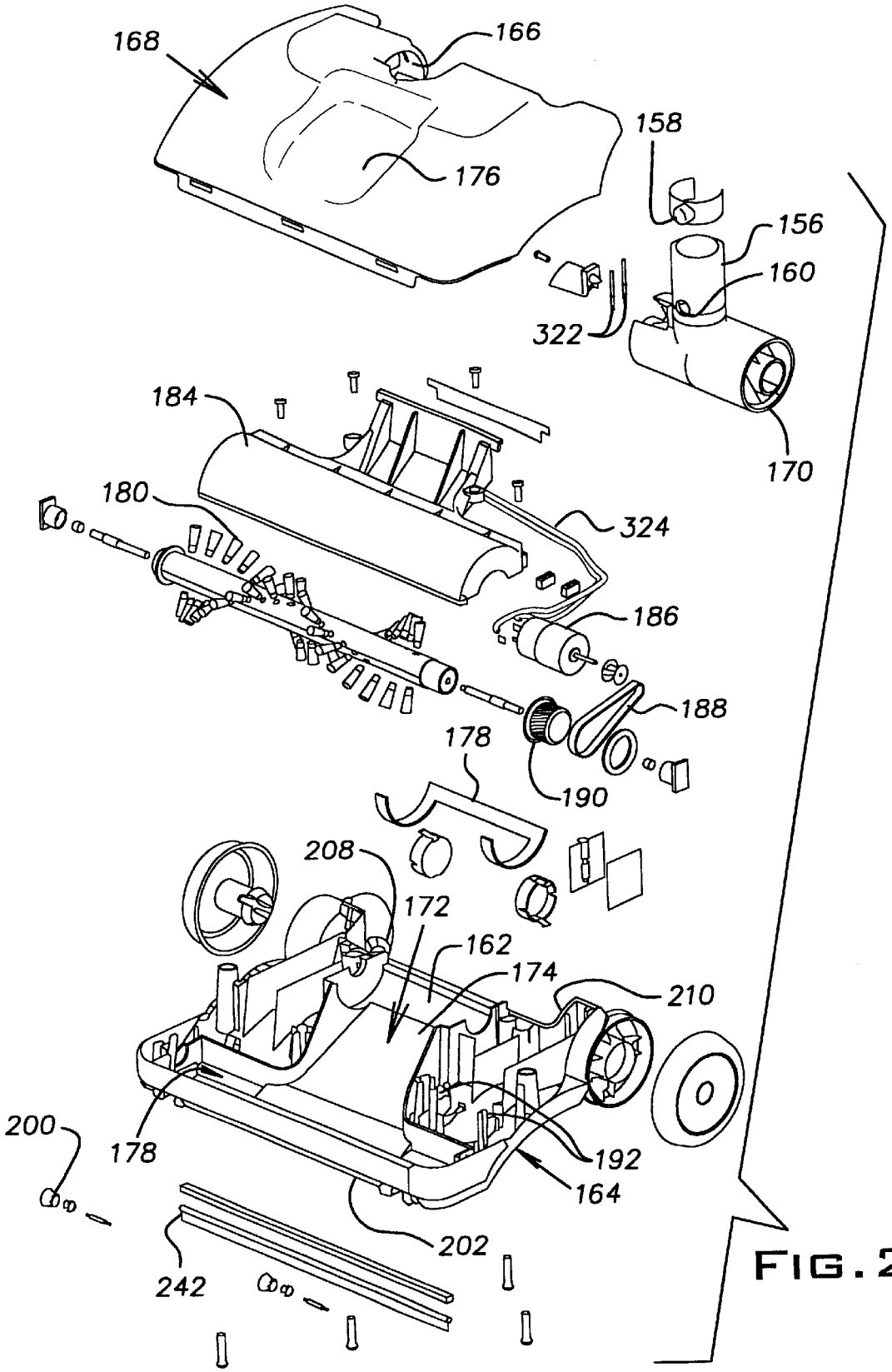
FIGS. 2A, 2B, and 2C, together comprise an exploded view of the vacuum cleaner.
Figure 2B:
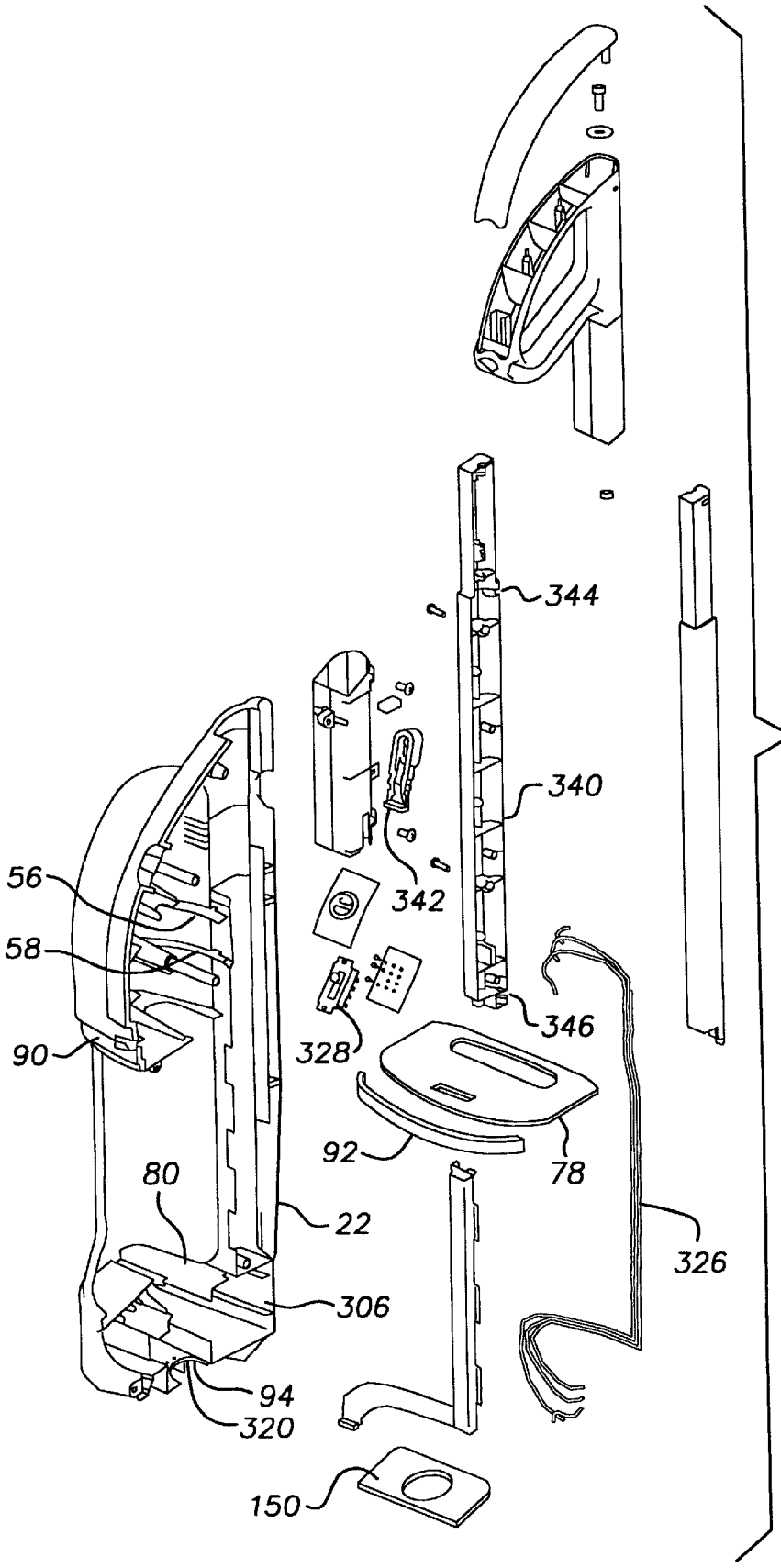

The inlet tube 96 and its opening 94 are seated on a gasket 150 which is provided on a T-joint and accessory holder 152 and the accessory mounting assembly 20. The holder 152 has a cylindrical socket 154 which receives a T-joint 156. The T-joint 156 is provided with a spring biased locking button 158 which projects through an aperture 160 in the socket 156. The button locks the T-joint in the socket and permits removal of the T-joint 156. The T-joint 156 has a hollow interior and is received between a cylindrical surface 162 in a lower nozzle member 164 and a complimentary cylindrical surface 166 in an upper nozzle member 168 (FIG. 2A). With the upper and lower nozzle members 168 and 164 assembled, the T-joint 156 is permitted to swivel between vertical and horizontal positions.

A suction inlet opening 170 is provided in a portion of the cylindrical side wall of the T-joint 156. When the handle and, therefore, the T-joint 156 is in an inclined operating position, the inlet opening 170 is in communication with an air inlet passage 172 formed by a wall 174 in the lower nozzle assembly 164 and a wall 176 in the upper nozzle assembly 168. The inlet opening 170 is otherwise sealed by a lower gasket nozzle 178 provided on the cylindrical surface 162. The passage 172 in turn communicates with an elongated chamber 178 in the lower nozzle member 164 which, in turn, is open to the floor or carpet being vacuumed.

A powered brush roll 180 having a multiplicity of bristles 182 is mounted for rotation in the chamber 178 and is covered by an inner shroud 184. The brush roll 180 is driven by a drive motor 186 through a driving belt 188 and a drive wheel 190 which is connected to one end of the brush roll 180. The drive motor 186 is mounted in the lower nozzle on motor mounting cradles 192.

Figure 12:
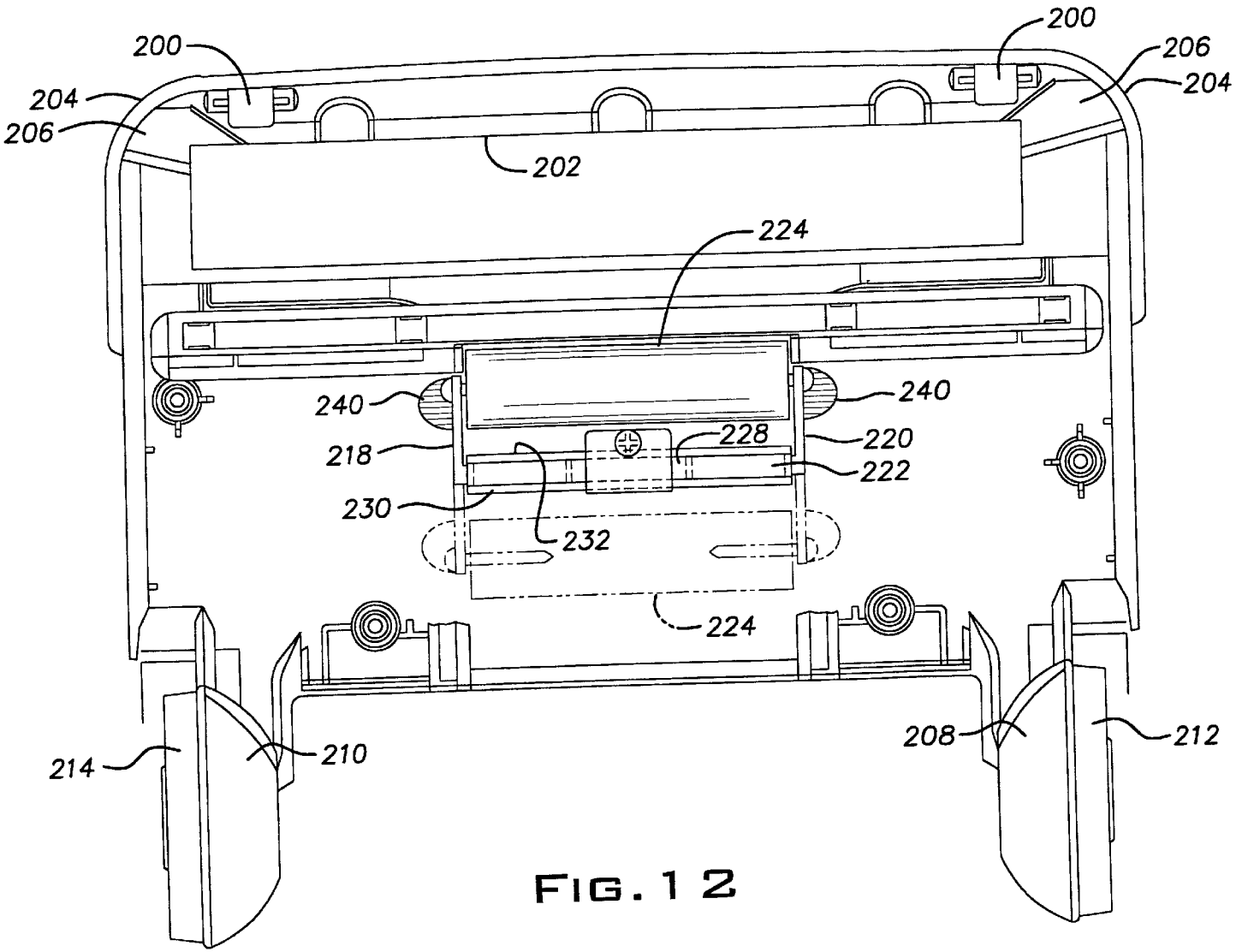
FIG. 12 is a bottom view of the rug nozzle illustrated in FIG. 11.

Referring to FIG. 12 and to the lower nozzle member 164, a pair of small front wheels 200 are provided ahead of brush roll air intake 202 and are spaced inwardly from front corners 204. The front corners 204 define recessed channels 206 in air communication with the brush roll air intake 202 to enhance edge and corner cleaning effectiveness. Toward the rear of the lower nozzle assembly 164, two rearwardly extending projections 208 and 210 rotatable mount a pair of relatively large rear wheels 212 and 214. The extensions 208 and 210 provide a space therebetween which allows the upper body assembly to pivot 90 degrees from a vertical storage position to a "ground-hugging" overall height that acids in gaining cleaning access under low objects, such as beds, chairs, couches, etc.

Figure 11:
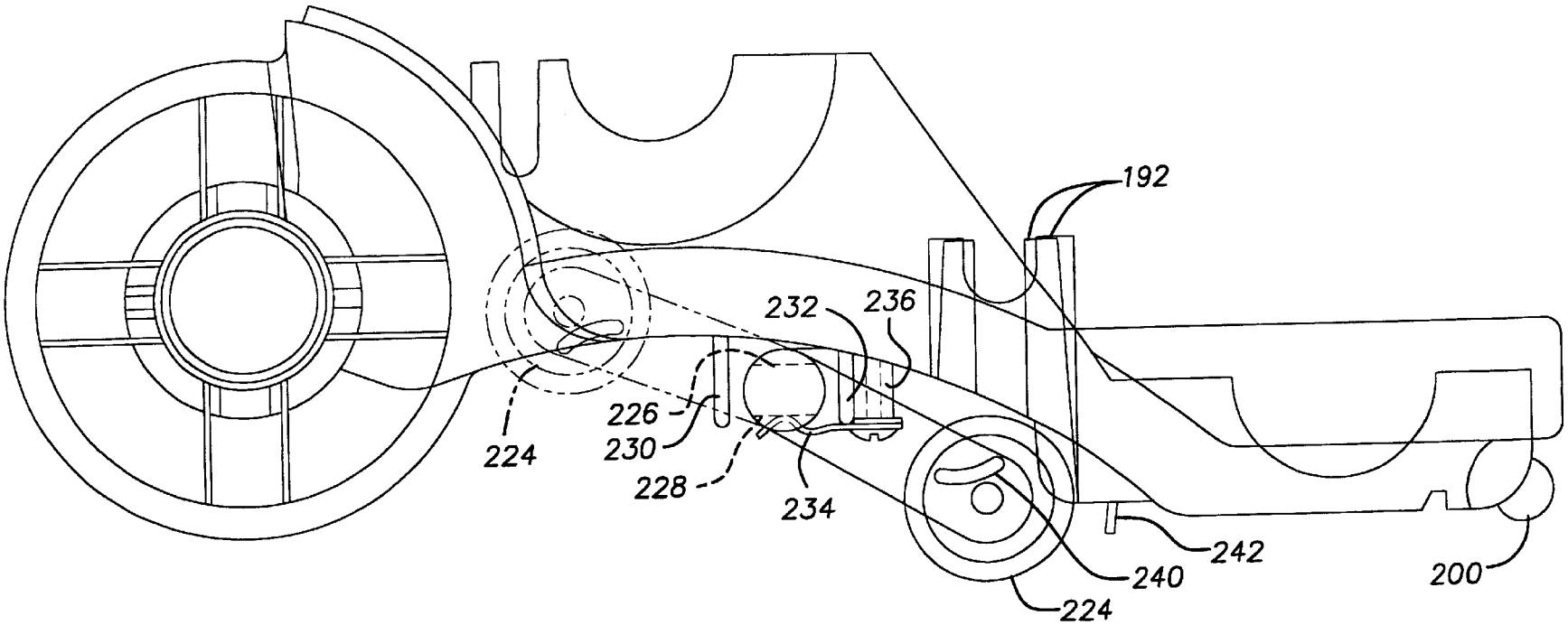
FIG. 11 is a sectional view of the rug nozzle according to another aspect of this invention.

A two position height adjustment mechanism 216 comprises a carriage formed by a pair of parallel links 218 and 220, which are fixed at one end to an axle 222. A roller 224 is rotatably mounted between the links 218 and 220. The axle 222 is provided with centrally located flattened portions 226 and 228 and is mounted for rotation between channel plates 230 and 232. A leaf spring 234 is mounted on a post 236 and retains the axle 222 and, therefore, the roller 224 in the position illustrated in solid outline in FIGS. 11 and 12. In that illustrated position the roller 224 tends to minimize penetration of the section inlet opening into plush or deep pile carpeting. For bare floors or short pile carpeting, the roller may be pivoted about 180 degrees to the position illustrated in phantom outline in FIG. 12 to permit the intake opening of the nozzle to be spaced a short distance from the floor. In its pivoted position the flattened portion 226 of the axle 228 engages the spring 234. To aid in moving the roller from its on the floor to its retracted position projecting finger grips 240 may be provided on the links 218 and 220. Further, a flexible scraper blade 242 is mounted just rear of the intake 202 of the nozzle to scrape any debris into a position to be picked up by the intake nozzle.

Figure 13:
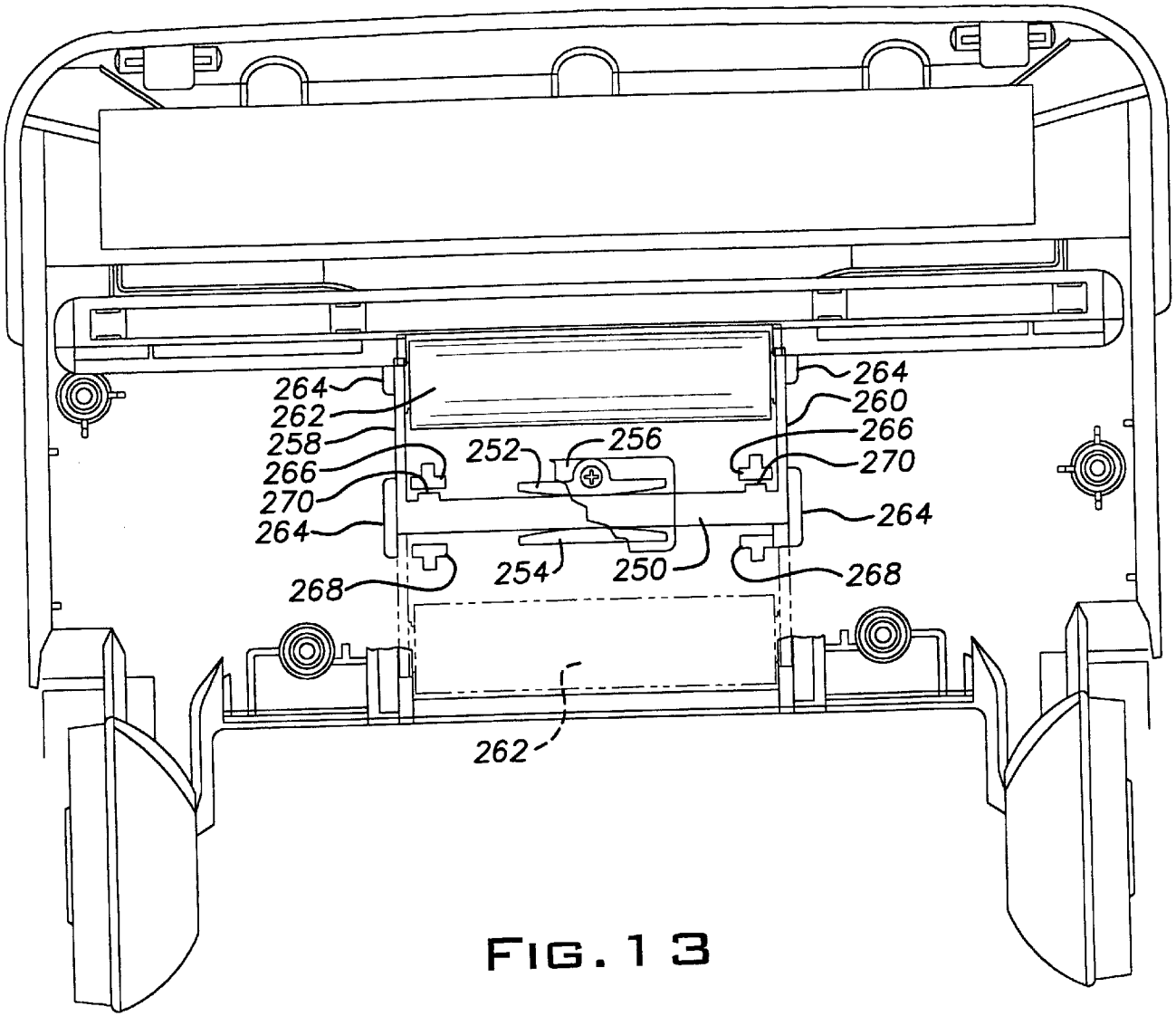
FIG. 13 is a bottom view of the rug nozzle illustrated in FIG. 12.

Referring now to FIG. 13 there is illustrated a height adjustment mechanism according to a further aspect of this invention. The mechanism includes an axle 250 which is mounted for pivotable movement between a pair of bearing plates 252 and 254. A retaining plate 256 covers and retains the axle 250 between the plates 252 and 254. A pair of links 258 and 260 are fixed to the axle 250 and rotatably mount a roller 262. Stabilizer ribs 264, which project from the cover, prevent movement of the roller 262 and the axle 250 in their axial directions. Pressure pads 266 and 268 are located on opposite sides of the axle 250 and frictionally engage cam projections 270 at the ends of the axle 250 when the roller 262 is in its operative illustrated position and its phantom outline position, respectively.

Figure 14:
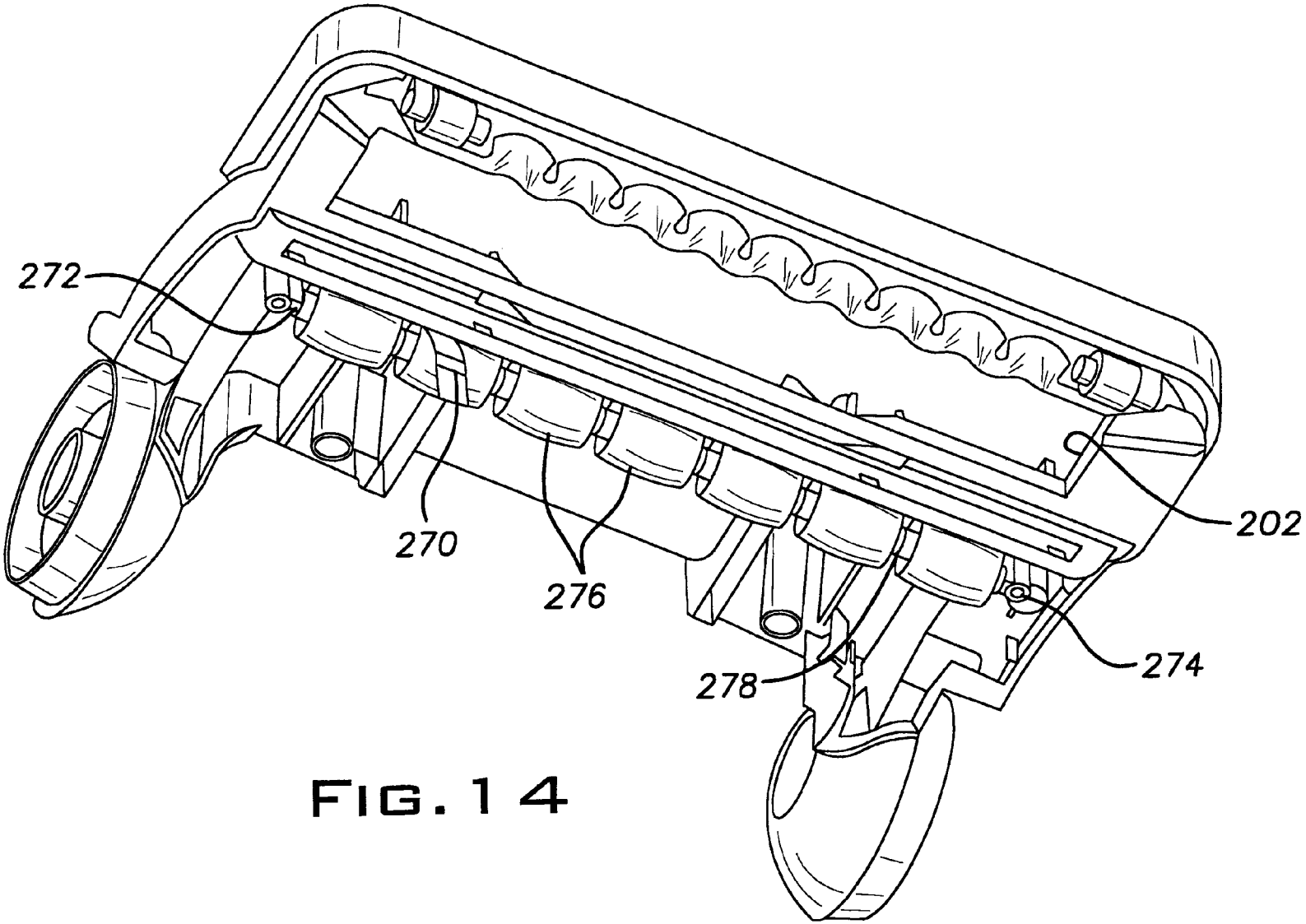
FIG. 14 is a perspective view of a rug nozzle according to another aspect of this invention.

Refer now to FIG. 14 there is illustrated a mechanism for providing a permanent elevation of the nozzle opening with respect to plush or deep pile carpeting. That mechanism includes an axle 270 which is transversely supported by end posts 272 and 274. A plurality of rotatable rollers 276 are mounted on the axle 270 which are provided with mutually interlocking ends 278 which join the rollers 276 as a rotational unit. The interlocking end configuration of the rollers 276 prevents hair and string buildup on the axle 270 during use. The rollers 276 provide spaces therebetween which ensure adequate vacuum suction to the nozzle intake 202.

Referring again to FIGS. 2A, 2B and 2C the brush roll motor 186 and the suction motor 26 are powered by a battery pack 280. The battery pack 280 includes a plurality of rechargeable batteries 282 which are electrically connected in series by a plurality of busbars 284. Additional busbars 286 and 288 provide contact points 290 and 292 in openings 294 and 296 in an upper battery case 298. The upper battery case 298 cooperates with a lower battery case 300 to provide the battery pack 280. A circuit board 302 is provided within the upper and lower battery cases to provide components which are required for recharging the battery. The recharging pin connector (not shown) may be inserted into an opening 304 formed by the upper and lower battery cases to recharge the batteries 282 when the battery pack 280 is removed from the vacuum cleaner or when the battery pack 280 is mounted in an operating position in the vacuum cleaner.

A battery compartment 306 is provided in the vacuum cleaner and has an inner configuration which conforms to the shape of the battery pack 280. It may be noted that the battery pack 280 is asymmetrical in that one corner 308 is provided with a slight radius. This prohibits the battery pack from being mounted in an inverted position within the compartment 306. The battery pack 280 is retained in the compartment 306 by a flexible detent 310 which engages a complimentary detent (not shown) within the compartment 306.

When the battery pack 280 is installed in the compartment 306, the contacts 294 and 296 are in electrical contact with contacts 312 and 314 which in turn supply d current from the battery pack 282 a pair of contacts 316 and 318 which are located in alignment with pin openings 320 in the housing adjacently opening 94 in the housing. When the T-joint 156 is inserted into the opening 94, socket pins 322 mounted on the T-joint 156 electrically engage the contacts 312 and 314. A wiring harness 324 electrically connects the pins 322 to the brush roll motor 186. A wiring harness 326 connects the contacts 312 and 314 to a multi-position switch 328 and connects the switch to a pair of pins 322. The switch 328 controls the supply of power to the motor 26. A first position of the switch 328 is an off position which prevents supply of power to the motor 186 and the motor 26. The switch has a second position which supplies power to both motors 186 and 26 and has a third position which supplies power only to the motor 26. The last mentioned position of the switch is utilized when bare floors are vacuumed without rotation of the brush roll.

The handle 16 includes a shaft 340 which is slidably received in the spine 22. A spring biased latch 342 engages an upper notch 344 to retain the handle in a retracted position, and engages a lower notch 346 to retain the handle in an extended position. the handle may also be removed from the spine 22, if the vacuum cleaner is used as a portable canister cleaner.

To use the vacuum cleaner as a portable canister cleaner, the T-joint 156 is removed from the holder 152 and a connector end 348 of an accessory hose 350 (FIG. 2C) is inserted into the holder 152. the connector end 348 is provided with electrical connector contact pins which are received in the pin openings 320 to provide power for a brush roll motor (not shown) in a cleaning accessory (also not shown) at the distal end of the hose 350.

Figure 2C:
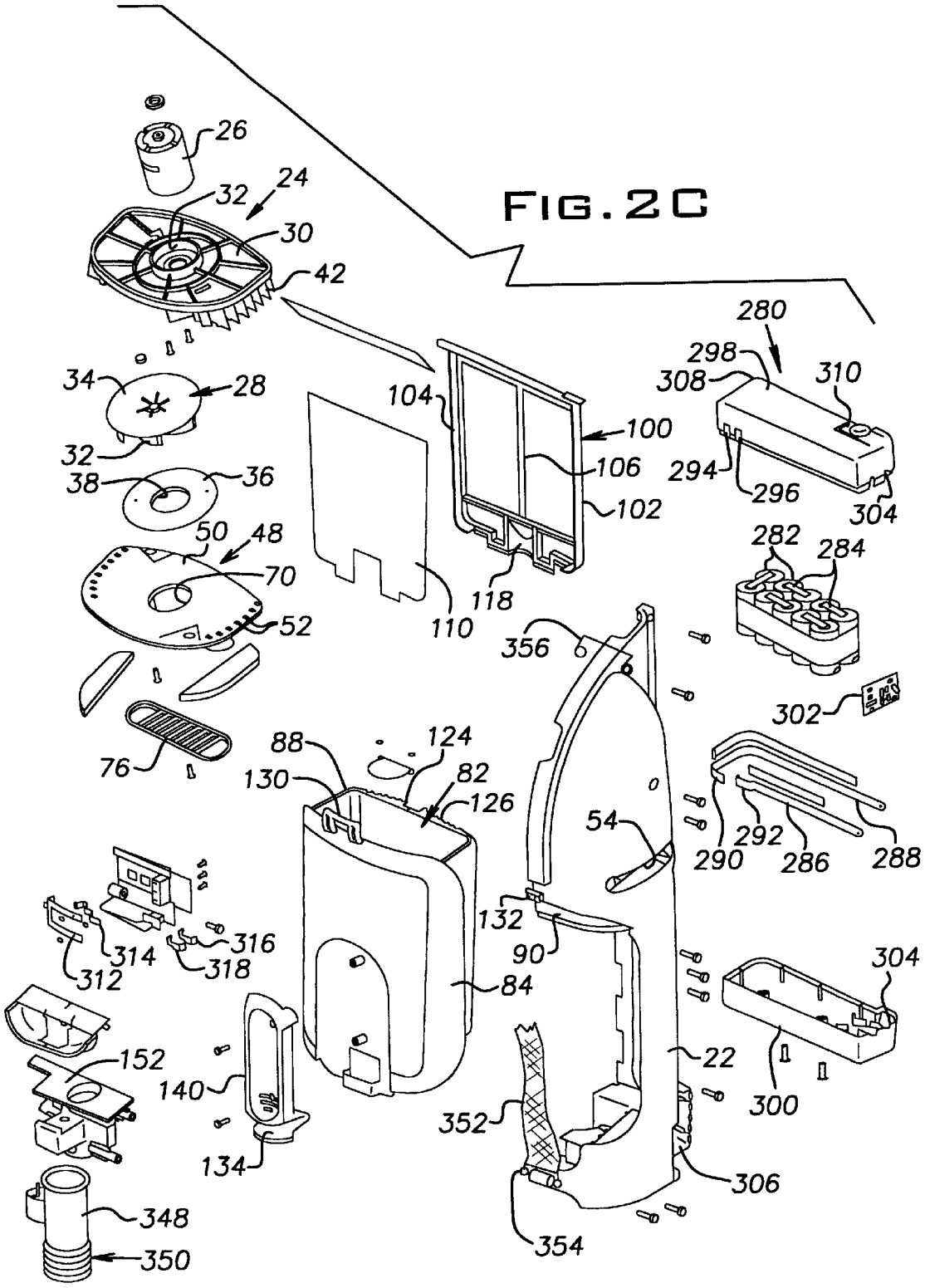

The upper body member 12 may be provided with a carrying strap 352 which is attached to the member 12 by links 354 and 356 as is indicated in FIG. 2C.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extend to which the progress in the art has been advanced by the invention.

What is claimed:

1. A vacuum cleaner comprising:

an elongated canister defining a motor housing;

a motor housing comprising an elongated casing having a longitudinal axis and an end wall;

a motor and fan assembly mounted in said housing, said fan having an axis of rotation angularly related to said longitudinal axis so that said fan presents a circular envelope of rotation when viewed in the direction of its axis of rotation and presents an elliptical envelope of rotation when viewed in the direction of said longitudinal axis;

an aperture defined by said end wall;

an air duct between said fan and said end wall;

a containment chamber having a proximal end removably attached to said end wall and a distal end defining an intake opening;

a substantially planar filter within said containment chamber and extending from said distal end to said proximal end of said containment chamber to separate said containment chamber into an air flow chamber and a dirt chamber;

said aperture being separated from air flow communication with said intake opening by said filter.

2. A vacuum cleaner assembly according to claim 1 wherein said fan comprises an impeller having a pair of circular discs, one of said discs having a circular central opening therethrough, a plurality of spaced curved vanes between said discs extending outwardly from said central opening to an outer periphery of each disc.

3. A vacuum cleaner assembly according to claim 2 wherein said air duct comprises an air guide cylinder axially projecting from said central opening and an air cone conduit having a circular opening at one end into which said air guide cylinder extends, and a laterally elongated opening at another end that communicates with said aperture defined by said end wall.

4. A vacuum cleaner according to claim 1 including a longitudinal spine mounting said motor housing at one end thereof and an accessory receiving assembly at another end thereof, said containment chamber being removably mounted on said spine between said motor housing and said accessory receiving assembly, a tubular opening defined by said accessory receiving assembly in fluid communication with the intake opening of said containment chamber.

5. A vacuum cleaner according to claim 4 wherein a floor and rug cleaning housing is attached to said accessory receiving assembly, said floor and rug cleaning housing including a floor and rug engaging nozzle having a floor and rug engaging inlet opening and an outlet tube, said outlet tube being T-shaped and having a cylindrical head pivotally received in a cylindrical socket having an inlet opening in fluid communication with the floor and rug inlet opening, an inlet opening in said head in communication with the inlet opening in said cylindrical socket, said outlet tube further having a hollow tail received within the tubular opening defined by said accessory receiving assembly.

6. A vacuum cleaner according to claim 5 wherein said floor and rug engaging nozzle is provided with front and rear rug and floor engaging wheels, a roller mounted on a bottom surface of said nozzle between said front and rear wheels and transverse to a direction of movement of movement of said nozzle, said roller and said rear wheels defining a plane of rug contact, with said front wheels being above said plane to elevate an air inlet opening of said nozzle for cleaning deep pile and plush carpeting.

7. A vacuum cleaner according to claim 6 wherein said roller is mounted on a fixed axle.

8. A vacuum cleaner according to claim 7 wherein said roller comprises a plurality of roller segments.

9. A vacuum cleaner according to claim 8 wherein said axle extends through said roller and wherein each segment has an end portion which interlocks with an end portion of an adjacent segment to prevent hair and string buildup on said axle.

10. A vacuum cleaner according to claim 9 wherein each segment has another end portion which defines a space between another end portion of an adjacent segment to ensure adequate vacuum suction to said nozzle intake.

11. A vacuum cleaner according to claim 6 wherein said roller is mounted on a roller axle and said roller axle is connected to a carriage moveable to position said roller between a first retracted position wherein said roller is above a plane defined by said front and rear wheels and a second extended position wherein said roller is below the plane defined by said front and rear wheels.

12. A vacuum cleaner according to claim 11 wherein said carriage is formed by a pair of parallel links fixed at one end to a carriage axle, said roller being rotatably mounted at another end of said links, said carriage axle having a pair of parallel centrally located flattened portions and being mounted for rotation between channel plates, a leaf spring retaining said carriage axle between said channel plates and retaining said roller in said first and second positions when engaging a flattened portion.

13. A vacuum cleaner according to claim 11 wherein said carriage is formed by a pair of parallel links fixed at one end to a carriage axle, said roller being rotatably mounted for pivotable movement between a pair of bearing plates, a retaining plate covering and retaining the carriage axle between the bearing plates, a pressure pad on opposite sides of said carriage axle adapted to frictionally engage cam projections adjacent each end of the carriage axle to retain said roller in said first and second positions.

14. A vacuum cleaner according to claim 5 including a battery pocket formed by a wall of said accessory receiving assembly and a battery pack removably mounted in said pocket.

15. A vacuum cleaner according to claim 14 including electrical contacts in said wall communicating with electrical contacts on said battery pack, electrical conductors extending from said contacts in said wall to an electrical connector socket adjacent to the tubular opening in said accessory receiving assembly.

16. A vacuum cleaner according to claim 15 including a rotatable brush roll extending across said floor and rug engaging inlet opening.

17. A vacuum cleaner according to claim 16 including a brush roll drive motor connected to said brush roll.

18. A vacuum cleaner according to claim 5 wherein said floor and rug cleaning housing has spaced rearwardly extending extensions, a wheel mounted in each extension, and wherein said elongated canister is adapted to be pivoted about said cylindrical socket so that said canister may be pivoted to a position between said extensions.

19. A vacuum cleaner according to claim 4 wherein a flexible accessory hose is attached to said tubular opening.

20. A vacuum cleaner according to claim 19 wherein said hose has a quick-connect electrical connector adapted to connect with a cooperating connector on said accessory receiving assembly.

21. A vacuum cleaner comprising:

an elongated canister defining a motor housing having a longitudinal axis and an end wall;

a motor and fan assembly mounted in said housing, said fan housing having an axis of rotation angularly related to said longitudinal axis so that said fan presents a circular envelope of rotation when reviewed in the direction of its rotation and presents an elliptical envelope of rotation when viewed in the direction of said longitudinal axis, a filter chamber having an outlet in communication with said fan and an inlet opening for receiving vacuumed debris, and parallel ribs provided on opposite sides of said chamber, and a filter in said filter chamber mounted on said parallel ribs and between said inlet opening and said outlet opening.

22. A vacuum cleaner assembly according to claim 21 wherein said fan comprises an impeller having a pair of circular discs, one of said discs having a circular central opening therethrough, a plurality of spaced curved vanes between said discs extending outwardly from said central opening to an outer periphery of said disc.

23. A vacuum cleaner assembly according to claim 22 wherein said motor is mounted on one side of a cover plate and has a fan drive shaft extending through said cover plate and mounting said fan, a plurality of air guide vanes along opposite lateral edges of said cover plate and providing space for said fan to rotate therebetween, a base plate having lateral edges fixed to said vanes and being spaced from said one of said discs, said base plate having an air passage opening communicating with said central opening of said one of said discs, said guide vanes having end tabs extending beyond the lateral edges of the cover plate and the base plate, said end tabs extending through a pair of slots in said motor housing to direct exhaust air from said fan and to mount said motor and fan assembly in said housing.

24. A vacuum cleaner assembly according to claim 23 including an aperture defined by said end wall, an air duct between said fan and said end wall, said air duct comprising an air guide cylinder axially projecting from said central opening and an air cone conduit having a circular opening at one end into which said air guide cylinder extends, and a laterally elongated opening at another end that communicated with said aperture defined by said end wall.

25. A vacuum cleaner comprising:

an elongated canister defining a motor housing;

a motor housing comprising an elongated casing having a longitudinal axis and an end wall;

a motor and fan assembly mounted in said housing, said fan having an axis of rotation angularly related to said longitudinal axis so that said fan presents a circular envelope of rotation when viewed in the direction of its axis of rotation and presents an elliptical envelope of rotation when viewed in the direction of said longitudinal axis;

an aperture defined by said end wall;

an air duct between said fan and said end wall;

a containment chamber having a proximal end removably attached to said end wall and a distal end defining an intake opening;

a substantially planar filter within said containment chamber and extending from said distal end to said proximal end of said containment chamber to separate said containment chamber into an air flow chamber and a dirt chamber;

said aperture being separated from air flow communication with said intake opening by said filter, an impeller mounted on said fan having a pair of circular discs, one of said discs having a circular central opening therethrough, a plurality of spaced curved vanes between said discs extending outwardly from said central opening to an outer periphery of said disc, wherein said motor is mounted on one side of a cover plate and has a fan drive shaft extending through said cover plate and mounting said fan, a plurality of air guide vanes along opposite lateral edges of said cover plate and providing space for said fan to rotate therebetween, and a base plate having lateral edges to said vanes and being spaced from said one of said discs, said base plate having an air passage opening communicating with said central opening of said one of said discs, said guide vanes having end tabs extending beyond the lateral edges of the cover plate and the base plate, said end tabs extending through a pair of slots in said motor housing to direct exhaust air from said fan and to mount said motor and fan assembly in said housing.

26. A vacuum cleaner comprising:

an elongated canister defining a motor housing;

a motor housing comprising an elongated casing having a longitudinal axis and an end wall;

a motor and fan assembly mounted in said housing, said fan having an axis of rotation angularly related to said longitudinal axis so that said fan presents a circular envelope of rotation when viewed in the direction of its axis of rotation and presents an elliptical envelope of rotation when viewed in the direction of said longitudinal axis;

an aperture defined by said end wall;

an air duct between said fan and said end wall;

a containment chamber having a proximal end removably attached to said end wall and a distal end defining an intake opening;

a substantially planar filter within said containment chamber and extending from said distal end to said proximal end of said containment chamber to separate said containment chamber into an air flow chamber and a dirt chamber;

said aperture being separated from air flow communication with said intake opening by said filter, an impeller mounted on said fan having a pair of circular discs, one of said discs having a circular central opening therethrough, a plurality of spaced curved vanes between said discs extending outwardly from said central opening to an outer periphery of said disc, wherein said motor is mounted on one side of a cover plate and has a fan drive shaft extending through said cover plate and mounting said fan, a plurality of air guide vanes along opposite lateral edges of said cover plate and providing space for said fan to rotate therebetween, a base plate having lateral edges to said vanes and being spaced from said one of said discs, said base plate having an air passage opening communicating with said central opening of said one of said discs, said guide vanes having end tabs extending beyond the lateral edges of the cover plate and the base plate, said end tabs extending through a pair of slots in said motor housing to direct exhaust air from said fan and to mount said motor and fan assembly in said housing, and an aperture defined by said end wall, an air duct between said fan and said end wall, said air duct comprising an air guide cylinder axially projecting from said central opening and an air cone conduit having a circular opening at one end into which said air guide cylinder extends, and a laterally elongated opening at another end that communicated with said aperture defined by said end wall.

* * * * *